United States Patent [19]

Hanhikoski et al.

[11] Patent Number: 4,642,164

[45] Date of Patent: Feb. 10, 1987

[54] METHOD AND ARRANGEMENT FOR WEB HANDLING

[75] Inventors: Hannu Hanhikoski; Lauri Kalliola, both of Järvenpää , Finland; Hannu Mälkiä, Appleton, Wis.

[73] Assignee: Oy Wärtsilä Ab, Helsinki, Finland

[21] Appl. No.: 698,075

[22] Filed: Feb. 4, 1985

[30] Foreign Application Priority Data

Feb. 8, 1984 [FI] Finland ..... 840515

[51] Int. Cl.[4] ..... D21G 1/00; D21G 7/00

[52] U.S. Cl. ..... 162/207; 8/149.3; 68/5 D; 68/13 R; 100/38; 100/93 RP; 162/DIG. 6; 162/375

[58] Field of Search ..... 8/149.3; 68/5 D, 13 R; 100/38, 43, 74, 75, 93 RP; 162/DIG. 6, 206, 207, 290, 359, 375; 34/54, 115; 118/67, 68, 665; 427/366, 382

[56] References Cited

U.S. PATENT DOCUMENTS

| | | | |
|---|---|---|---|
| 2,617,743 | 11/1952 | Grimm | 427/366 X |
| 3,767,900 | 10/1973 | Chao et al. | 162/DIG. 6 |
| 4,050,630 | 9/1977 | Dupasquier | 162/290 X |
| 4,157,595 | 6/1979 | von der Eltz et al. | 68/13 R X |
| 4,277,524 | 7/1981 | Nakajima et al. | 118/67 X |
| 4,370,923 | 2/1983 | Schmidt | 100/93 RP X |

*Primary Examiner*—Philip R. Coe

*Attorney, Agent, or Firm*—Dellett, Smith-Hill and Bedell

[57] ABSTRACT

A method for the moistening of an endless web moving in a processing device, wherein the moistening substance is an evaporated fluid condensated on the web and said web is treated with a corresponding steam substance prior to this moistening. The method includes steps for supplying the evaporated fluid in a bag-like member formed by the web, the bag-like member being supported by an external member. The supply of the substance is carried out by means of a steamer appliance arranged transverse to the web. The method includes steps for adjusting the specific property of the steam substance in accordance to specific values measured from the web. The steamer appliance for the substance supply is separated from the external web support, the adjusted specific property being the steam current or the total amount of the steam and being distributed between separate zones in the web transverse direction, whereby the distribution is controlled by means of the ratio of the measured local specific value corresponding the zones. The method includes the generation of a pressure difference between the interior of the bag-like member and the space outside the web. The measurement of the specific value is continuously carried out in the transverse direction of the web.

15 Claims, 2 Drawing Figures

METHOD AND ARRANGEMENT FOR WEB HANDLING

BACKGROUND OF THE INVENTION

The invention relates to a method, and to an arrangement for the application of said method, for the moistening of an endless web by a vaporized liquid, said web moving in a processing device.

A uniform quality is often required in a web, both in its longitudinal direction and transverse direction. It is especially important in the case of a paper web used in printing machines that a desired property, for instance glazing, thickness, density, the shrinking or the elongation property, be the same at different locations of the web. These properties are generated in the web in finishing processes thereof, for instance by calendering a moistened web. Consequently the local moisture content should not exceed a certain maximum value.

The U.S. Pat. No. 3,838,000 discloses a method for a web moistening prior to guiding the web into a calender. The average moisture generated in the web is rather low, in order not to exceed the maximum value locally. As a result, the desired property generated by this method varies considerably at different locations of the web. This property in the transverse direction of the web, for instance, is dependent on the distribution of the moistening substance taken by the web and on the calendering effect in this direction.

Attempts have been made to eliminate the variation of the desired property by arranging, in connection with the calender and in the transverse web direction, a moistening device which is divided into separate sections in said direction. The moisture of the web is increased by this moistening device. The device is located outside a web pocket, which is formed by the web guided around a so-called fly roll located at the side of the calender. A problem exists, however, in that there is no correlation between the desired property and the flow of the moistening substance supplied from a section. This means that the flow supplied from the section cannot compensate for the variations of this property taken by a web area affected by this section. Moreover, different sections operate mutually independently, whereby said property can by sections differ in the transverse direction of the web. Furthermore, a rather large portion of the moistening substance, supplied from outside the web pocket, will not at all contact the web but is directed to the environment.

Rather complicated devices located in a web pocket are presented in British Patent Specification No. 1,101,767 and German Patent Specification No. 328,786. The former device is a web deflecting bar in a calender stack, whereas the latter one is not suited for a use in a vertical calender.

OBJECTS AND SUMMARY OF THE INVENTION

The object of the invention is to provide a method and an arrangement, by which the moistening substance transferred into the web can be adjusted in order to provide the desired property in the web, for instance the web thickness, density, glazing degree, the shrinking or the elongation property. A further object is make this adjustment possible so that the desired property is applied as the factor controlling the adjustment.

In accordance with the invention, the measured value of a property of the web can be used for the control of the steam supply adjustment. This is possible by adjusting a specific property of the steam substance according to specific values measured from the web. The best correlation between the adjustment and the moistening is produced by placing the zoned steamer appliance inside a bag-like member formed by the web, whereby the web itself forms walls. The appliance is separate from the external member, say for instance, a fly-roll. The penetration of the steam substance in the web can be boosted-up by arranging a pressure difference on opposite wall sides, for instance by an excess pressure of the steam substance inside the bag-like member.

The adjusted property of the steam substance is steam flow or the total quantity of the steam which is distributed among separate zones in the transverse direction of the web. The specific value measured from the web can be the web thickness, density, glazing, the moisture quantity and/or the like. This procedure is well suited in the paper web handling. An efficient adjustment of the feedback type is possible by measuring the specific value, so that the measurement location is at a considerable distance from the bag-like member in the web running direction. A favourable embodiment is realized in a calender appliance, in which the specific value is measured at a web portion fed out of the appliance. By continuously carrying out the adjustment of the specific quantity and the measurement of the specific value, a treated web with uniform quality is possible. This arrangement is furthermore well suited for an automated web handling process. An easily controlled guidance and supply is possible by a zoned division of the steam current in the direction of the steamer appliance. The distribution of the steam flow for different zones is hereby set to correspond to the ratio of the specific values controlling the sections. By this means a steam flow adjustment at a constant level can be divided in the web transverse direction, in order to produce homogeneously handled web.

The arrangement aimed for the application of the method according to the invention is characterized in that the specific quantity of the steam substance, which is supplied by a zoned steamer appliance set in a bag-like web member and in the transverse web direction, is adjusted in accordance with specific values, which are measured from the web by a measuring gauge. The same specific values are preferably also applied for the adjustment of the specific quantity in a first steamer appliance, which can be located in a previous web pocket or outside the calander stack.

Both the substance amount and the distribution thereof in the steamer zone, of the specific property supplied by the steamer like the steam current, can be adjusted by arranging an appliance valve and zone valves in the steamer appliance. The function of the valves is controlled by continuously operated gauges, which measure the specific value all over the web and locally. One favourable embodiment comprises continuously operated moisture gauges, by which the final moisture of the web fed out of the calender is measured. If a gauge which scans the web transverse extension by a fro-and-back motion is used, only one gauge is needed.

BRIEF DESCRIPTION OF THE DRAWING

The invention is described in the following with reference to the attached drawing, in which FIG. 1 discloses a general view of an embodiment of the invention, FIG. 2 discloses a modification of a steamer appliance according to the invention.

DESCRIPTION AND A PREFERRED EMBODIMENT OF THE INVENTION

Figure 1:
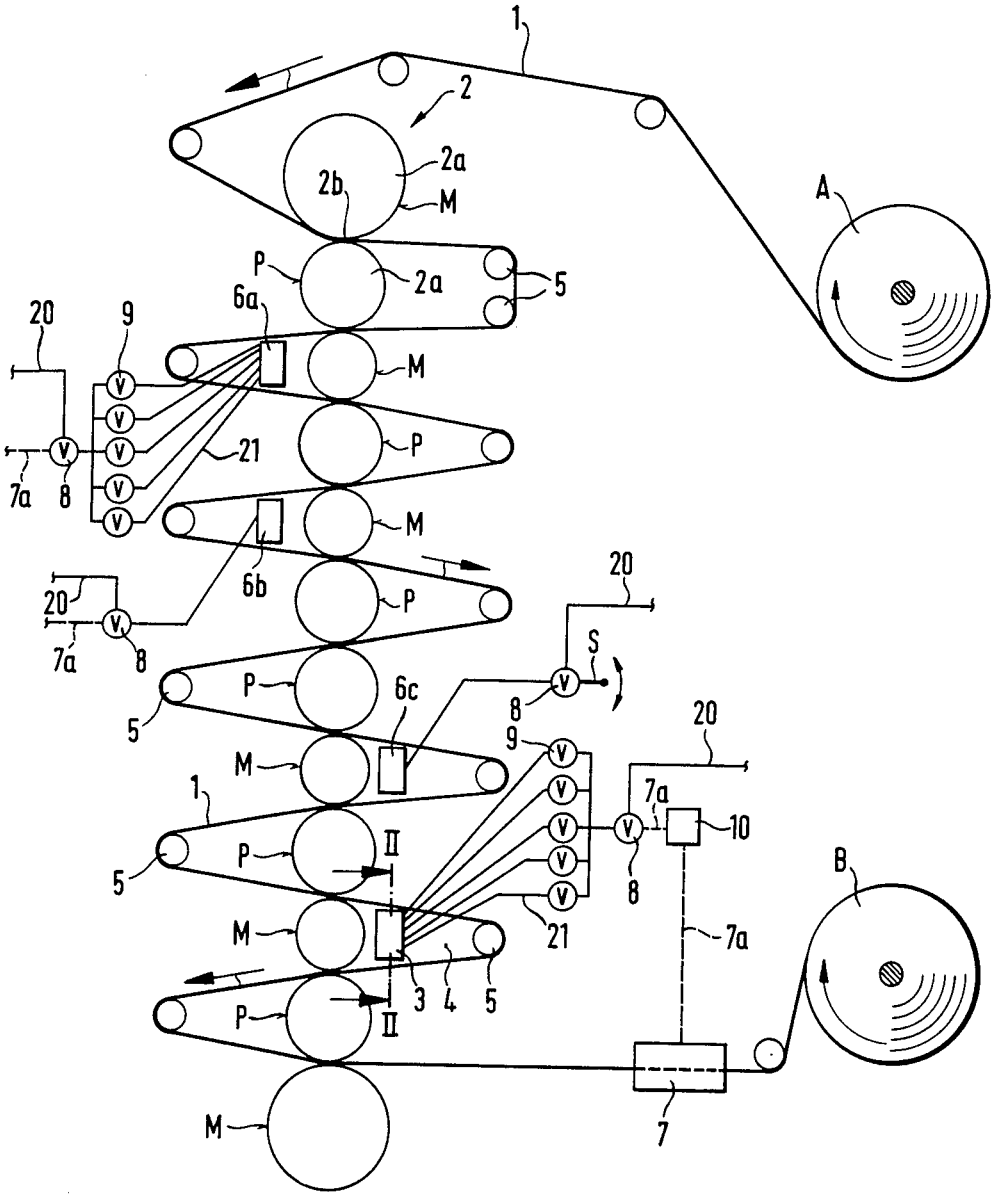

A moving, endless web 1 supplied from a roll A is guided through a calender stack 2 and guided to a further treatment, an example of which is the winding of web 1 to form a roll B. Web 1 moves in calender 2 through nips 2*b* between rolls 2*a* and around a fly-roll 5. Calender 2 comprises metal surfaced rolls M and fibre surfaced rolls P. Guided around the roll 5, web 1 forms a pocket 4. In order to moisten web 1 with steam, the necessary number of pockets 4 are provided with steamer appliances. In a pocket near the outfeed end of calender 2 is located a steamer appliance 3 divided into zones, the zones of which are one after another in the transverse direction of web 1. In the running direction of web before this steamer 3 is located at least one leading steamer, which by way of example is disclosed by devices 6*a*, 6*b* and 6*c*. The pressurized steam supply of zoned steamer 3 is adjusted by a moisture gauge 7, an appliance valve 8, zone valves 9 and a control apparatus 10. Gauge 7 comprises several sensors located in the transverse direction of web 1, so that the moisture can be measured within the web portion treated by a zone of steamer 3, and all over the width of web 1 by integration. Instead of several measuring sensors, the gauge 7 may comprise one measuring sensor that is movable in the web transverse direction. The sensor can, for instance, continuously scan the path of the measurement by a fro-and-back motion. The locations of the sensor and the web are mutually arranged within the same observation scale indicating the position by some usual measure.

The measurement signal of gauge 7 is supplied to control device 10, which generates in response to the measurement signal a control signal for adjusting the valves 8,9. FIG. 1 shows a signal circuit 7*a* of gauge 7, which co-operates with control device 10, appliance valve 8 and a supply pipe 20. The control signal circuit for the zone valves 9 is not shown. The steam pipe controlled by zone valves 9 is indicated by reference numeral 21.

Instead of the presented on-line function of gauge 7, the measurement can be manually carried out from web 1 and the result of the measurement transmitted to control device 10 by a usual data input supply means. Gauge 7 and device 10 are then, naturally, separate from each other.

FIG. 1 presents leading steamers 6*a*, 6*b*, 6*c*, which influence web 1 prior to steamer 3. In this example, steamer 6*a* corresponds structurally with steamer 3, so that valves 8,9 can be governed either manually or in dependence upon the measurement signal of a gauge for measuring the quality of a glaze, which gauge is located prior to steamer 3. Steamer 6*b* is a single-zone device, the steam supply of which is governed by appliance valve 8 only according to some measurement signal. Steamer 6*c* presents a usual single-zone steamer, in which the steam adjustment is manually set to a desired value by means of an on-off switch S.

These leading steamers 6*a*–6*c* can according to the invention be varied in a number of different ways. These steamers can comprise, for example, one such of some type cited, which can also be located prior to calender 2.

If gauge 7 is selected to be a device for measuring the thickness of web 1, steamer 3 or steamers 3, 6*a* and 6*b* can also be so governed that the thickness of web 1 is controllable. The earlier cited measurement of glazing on web 1 can be performed in the same manner by a suitable gauge 7. One can also arrange in connection with roll B an arrangement 7 measuring its density, whereby the steam supply and the density are set mutually to correlate.

Figure 2:
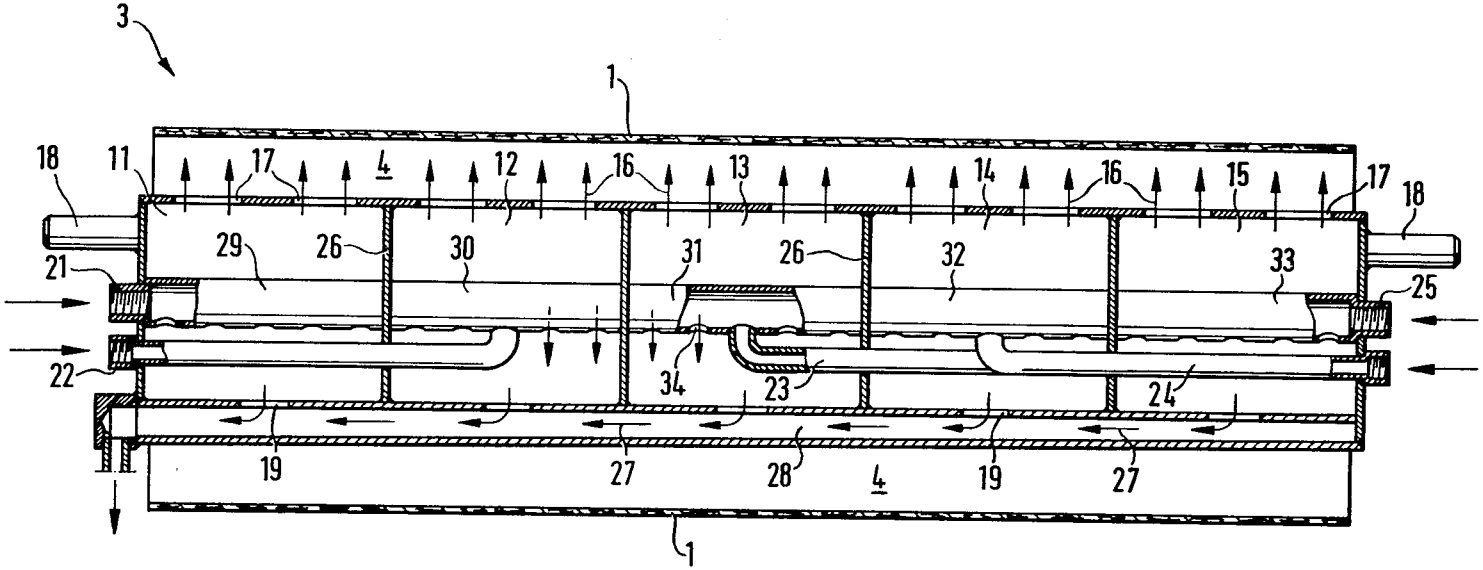

FIG. 2 presents an embodiment of a zoned steamer 3. The steamer comprises zones 11–15, in to which the steam is supplied through pipes 21–25. Each zone is separated by a wall 26. The steam enters zones 11–15 via distribution pipes 29–33 and openings 34. Steam 16 is directed from zones 11 in to pocket 4 through openings 17. Steamer 3 is supported at its supports 18. The condensate 27 that condenses each zone is directed through openings 19 and via a duct 28 for recycling. The illustrated duct 28 functions in self-pressurized manner, that is, condensate 27 moves by means of gravity in duct 28, which is tilted downwards. The moisture in roll A can be measured prior to the treatment of web 1 in calender 2, for example, in a paper-making machine, and the measurement result brought to the calender by some data transfer means.

The invention is not limited to the embodiments shown, but several modifications thereof are feasible within the scope of the attached claims.

We claim:

1. A method of moistening a running web that bounds at least partially a moistening pocket defined by first and second rolls that are in parallel, spaced apart relationship, the web contacting the first roll at two substantially diametrically opposed positions and being wrapped around the second roll, the method comprising delivering moistening substance in its vapor phase into the moistening pocket at a plurality of moistening locations that are spaced apart in the transverse direction of the web, whereby the vapor condenses on the web and moistens it, measuring the value of a property of the web at a plurality of measuring locations that are downstream of the moistening pocket with respect to the direction of travel of the web and are spaced apart in the transverse direction of the web, the value of the property depending upon the moistness of the web, and separately controlling the rate at which moistening substance is delivered to each moistening location in dependence upon the measured value of said property.

2. A method according to claim 1, wherein the property having the value that is measured is selected from the group consisting of moisture content, thickness and glaze.

3. A method according to claim 1, wherein the measuring locations are located a substantial distance from the moistening pocket.

4. A method according to claim 1, wherein the moistening pocket is defined by a calender roll of a calender appliance and a fly roll, and the measuring locations are downstream of the calender appliance with respect to the direction of travel of the web.

5. A method according to claim 1, comprising measuring the value of the property substantially simultaneously at all of said measuring locations.

6. A method according to claim 1, comprising measuring the value of the property at the different measuring locations sequentially.

7. Apparatus for moistening a running web, comprising first and second rolls in parallel, spaced apart relationship, about which the web can be trained so that the web contacts the first roll at two substantially diametrically opposed positions and is wrapped around the second roll and bounds at least partially a moistening pocket, and the apparatus also comprising means for delivering moistening substance in its vapor phase into the moistening pocket at a plurality of moistening locations that are spaced apart in the transverse direction of the web, means for measuring the value of a property of the web at a plurality of locations that are downstream of the moistening pocket with respect to the direction of travel of the web and are spaced apart in the transverse direction of the web, the value of which property depends on the moistness of the web, and means for separately controlling the rate at which moistening substance is delivered to each moistening location in dependence upon the measured values of said property.

8. Apparatus according to claim 7, wherein the first roll is a roll of a calender stack and the second roll is a fly roll adjacent the calender stack.

9. Apparatus according to claim 7, wherein the means for delivering moistening substance comprise a steamer appliance that extends transversely of the web and defines an interior chamber that is divided into separate zones corresponding respectively to said moistening locations.

10. Apparatus according to claim 9, wherein the means for controlling the rate at which moistening substance is delivered to each moistening location include an appliance valve for controlling the supply of moistening substance to the steamer appliance and a plurality of zone valves for controlling supply of moistening substance from the appliance valve to the interior chambers respectively.

11. Apparatus according to claim 10, wherein the first roll being a roll of a calender stack is the second roll being a fly roll, the means for measuring the value of the property of the web comprise a moisture gauge located downstream of the calender stack with respect to the direction of travel of the web, and the means for controlling the rate at which moistening substance is delivered to each moistening location comprise a valve controller that is connected to receive a measuring signal from the moisture gauge and is connected to provide control signals to the appliance valve and to the zone valves.

12. Apparatus according to claim 7, wherein the means for meaasuring the value of the property of the web comprise a measuring gauge for measuring the value of the property at the plurality of locations substantially simultaneously.

13. Apparatus according to claim 7, wherein the means for measuring the value of the property of the web comprise a measuring gauge that is movable in the transverse direction of the web for measuring the value of the property at the plurality of locations sequentially.

14. A method according to claim 1, comprising delivering moistening substance into the moistening pocket at a rate sufficient to maintain the pressure inside the moistening pocket at a level that is higher than the pressure outside the moistening pocket.

15. A method of moistening a running paper web that bounds at least partially a moistening pocket defined by first and second rolls that are in parallel, spaced apart relationship, the web contacting the first roll at two substantially diametrically opposed positions and being wrapped around the second roll, the method comprising:

delivering steam into the moistening pocket at a plurality of moistening locations that are spaced apart in the transverse direction of the web, whereby the steam condenses on the web and moistens it, the rate of delivery of steam being sufficient to maintain the pressure inside the moistening pocket at a level that is higher than the pressure outside the moistening pocket, measuring the thickness of the web at a plurality of locations that are downstream of the moistening pocket with respect to the direction of travel of the web and are spaced apart in the transverse direction of the web, and separately controlling the rate at which steam is delivered to each moistening location in dependence upon the measured value of the thickness of the web.

* * * * *